US012540534B2

(12) United States Patent
Perisho et al.

(10) Patent No.: US 12,540,534 B2
(45) Date of Patent: Feb. 3, 2026

(54) ESP WITH IMPROVED DEPLOYMENT FOR LIVE INTERVENTION

(71) Applicant: Baker Hughes Oilfield Operations LLC, Houston, TX (US)

(72) Inventors: Randal Perisho, Tulsa, OK (US); Shawn Gunter, Tulsa, OK (US); Risa Rutter, Oklahoma City, OK (US); Sean Cain, Tulsa, OK (US)

(73) Assignee: Baker Hughes Oilfield Operations, LLC, Houston, TX (US)

( * ) Notice: Subject to any disclaimer, the term of this patent is extended or adjusted under 35 U.S.C. 154(b) by 0 days.

(21) Appl. No.: 18/121,137

(22) Filed: Mar. 14, 2023

(65) Prior Publication Data

US 2023/0287772 A1 Sep. 14, 2023

Related U.S. Application Data

(60) Provisional application No. 63/319,693, filed on Mar. 14, 2022.

(51) Int. Cl.
*E21B 43/12* (2006.01)
*E21B 23/08* (2006.01)

(52) U.S. Cl.
CPC ..... *E21B 43/128* (2013.01); *E21B 23/08* (2013.01)

(58) Field of Classification Search
CPC ..... E21B 23/02; E21B 43/128
See application file for complete search history.

(56) References Cited

U.S. PATENT DOCUMENTS

| | | | | |
|---|---|---|---|---|
| 3,853,430 | A | 12/1974 | Grumman | |
| 4,440,221 | A | 4/1984 | Taylor et al. | |
| 4,773,489 | A | 9/1988 | Makohl | |
| 5,145,007 | A | 9/1992 | Dinkins | |
| 5,145,592 | A | 9/1992 | Caporiccio | |
| 5,620,048 | A * | 4/1997 | Beauquin | E21B 43/128 166/66.4 |
| 9,074,592 | B2 | 7/2015 | Morrison et al. | |
| 9,255,457 | B2 | 2/2016 | Scarsdale et al. | |
| 10,253,606 | B1 | 4/2019 | Artinian et al. | |
| 11,085,260 | B2 | 8/2021 | Aladawy et al. | |
| 2010/0288501 | A1 | 11/2010 | Fielder et al. | |
| 2011/0240312 | A1 | 10/2011 | Varkey et al. | |
| 2011/0300008 | A1 | 12/2011 | Fielder et al. | |
| 2012/0024543 | A1 | 2/2012 | Head | |
| 2013/0277042 | A1 | 10/2013 | Scarsdale et al. | |
| 2016/0003016 | A1 | 1/2016 | Chang et al. | |

(Continued)

OTHER PUBLICATIONS

International Search Report and Written Opinion for PCT/US2023/015158 mailed Jul. 17, 2023.

*Primary Examiner* — Robert E Fuller
(74) *Attorney, Agent, or Firm* — Crowe & Dunlevy, P.C.

(57) ABSTRACT

A pumping system is designed for deployment and retrieval through the production tubing in a live well intervention. The pumping system includes a pump driven by a motor, which may be an integrated motor or a separated motor in which the stator and rotor are separated by the production tubing. The pumping system can be provided power through a reinforced power cable that is capable of supporting the weight of some combination of the motor and pump, or through a standard power cable that is not designed to carry the weight of additional downhole components.

14 Claims, 9 Drawing Sheets

(56) References Cited

U.S. PATENT DOCUMENTS

| | | | | |
|---|---|---|---|---|
| 2016/0010439 | A1* | 1/2016 | Parmeter | F04D 7/04 415/104 |
| 2016/0194939 | A1 | 7/2016 | Lastra et al. | |
| 2018/0283384 | A1 | 10/2018 | AlAdawy et al. | |
| 2019/0017357 | A1 | 1/2019 | Head et al. | |
| 2020/0095852 | A1 | 3/2020 | Lastra et al. | |
| 2020/0217184 | A1* | 7/2020 | Biddick | E21B 33/12 |
| 2022/0259956 | A1* | 8/2022 | Ejim | F04D 29/043 |

* cited by examiner

ESP WITH IMPROVED DEPLOYMENT FOR LIVE INTERVENTION

RELATED APPLICATIONS

This application claims the benefit of U.S. Provisional Patent Application Ser. No. 63/319,693 filed Mar. 14, 2022 entitled, "ESP with Improved Deployment for Live Intervention," the disclosure of which is incorporated by reference as if fully set forth herein.

FIELD OF THE INVENTION

This invention relates generally to the production of hydrocarbons from a subterranean formation using an electric submersible pumping system, and more particularly, but not by way of limitation, to systems for deploying an electric submersible pumping system within a live wellbore.

BACKGROUND

Submersible pumping systems are often deployed into wells to recover petroleum fluids from subterranean reservoirs. Typically, the submersible pumping system includes a number of components, including one or more electric motors coupled to one or more pumps. Each of the components and sub-components in a submersible pumping system is engineered to withstand the inhospitable downhole environment, which includes wide ranges of temperature, pressure and corrosive well fluids.

Conventional electric submersible pumping systems are connected to surface facilities through rigid production tubing. The pumping system and tubing are often run inside of a cased wellbore and the production fluids are pumped to the surface through the production tubing. Although widely adopted, the use of rigid production tubing presents several deficiencies. In particular, the use of long lengths of rigid production tubing requires a workover rig with sufficient height to retrieve and deploy the long sections of production tubing. Workover rigs are often expensive and difficult to source.

As an alternative to the use of rigid production tubing, pump manufacturers have designed systems in which an electric submersible pumping system is installed within the wellbore using a wireline deployment system. Although these systems have achieved some commercial success, there remains a need for improved systems and methods for deploying an electric submersible pumping system within a live well. It is to this and other deficiencies in the prior art that embodiments of the present disclosure are directed.

SUMMARY OF THE INVENTION

Embodiments of the present disclosure are directed to a pumping system that is well-suited for deployment and retrieval through the production tubing in a live well intervention. In each embodiment, the pumping system includes a pump driven by a motor, which may be an integrated motor or a separated motor. The pumping system can be provided power through a reinforced power cable that is capable of supporting the weight of some combination of the motor and pump, or through a standard power cable that is not designed to carry the weight of additional downhole components. The integrated motor and separated motor can each be provided with internal compensators that are configured to accommodate the expansion of internal liquid lubricants. The pump can be provided with an internal thrust bearing to offset the axial loads generated by the pumping system during use.

In one aspect, embodiments disclosed herein include a method of deploying a submersible pumping system through production tubing in a wellbore. The method includes the steps of lowering a pump through the production tubing, locating the pump on a landing assembly within the production tubing, connecting a reinforced power cable to an upper end of a motor, lowering the motor into the production tubing, and landing the motor onto the pump within the production tubing. In these embodiments, the weight of the motor is carried by the reinforced power cable.

In another aspect, embodiments disclosed herein include a method of deploying and retrieving a submersible pumping system through production tubing in a wellbore, in which the submersible pumping system includes a motor and a pump driven by the motor. The method includes the steps of connecting the pump to a lower end of the motor, connecting a tether to an upper end of the motor, lowering the pump and motor into the production tubing while the weight of the pump and motor is carried by the tether, locating the pump on a landing assembly within the production tubing, lowering a power cable into the production tubing, and connecting the power cable to the motor in situ within the production tubing.

In yet other embodiments, the present disclosure is directed to a method of deploying a submersible pumping system within a well that includes the steps of installing production tubing in the well, securing an external stator to the outside of the production tubing, connecting a pump to a lower end of a rotor, lowering the rotor and pump through the inside of the production tubing to a location at which the rotor is positioned inside the production tubing in proximity to the external stator, and driving the pump with the rotor to discharge fluids out of the well through the production tubing.

In other embodiments, the present disclosure is directed to a downhole pumping system for use in producing fluids to the surface through production tubing. The downhole pumping system includes a separated motor in which the stator is mounted to the outside of the production tubing and the rotor is mounted to the inside of the production tubing. The rotor is positioned inside the production tubing in proximity to the stator and configured for rotation inside the production tubing. A pump is driven by the rotor.

WRITTEN DESCRIPTION

Figure 1:
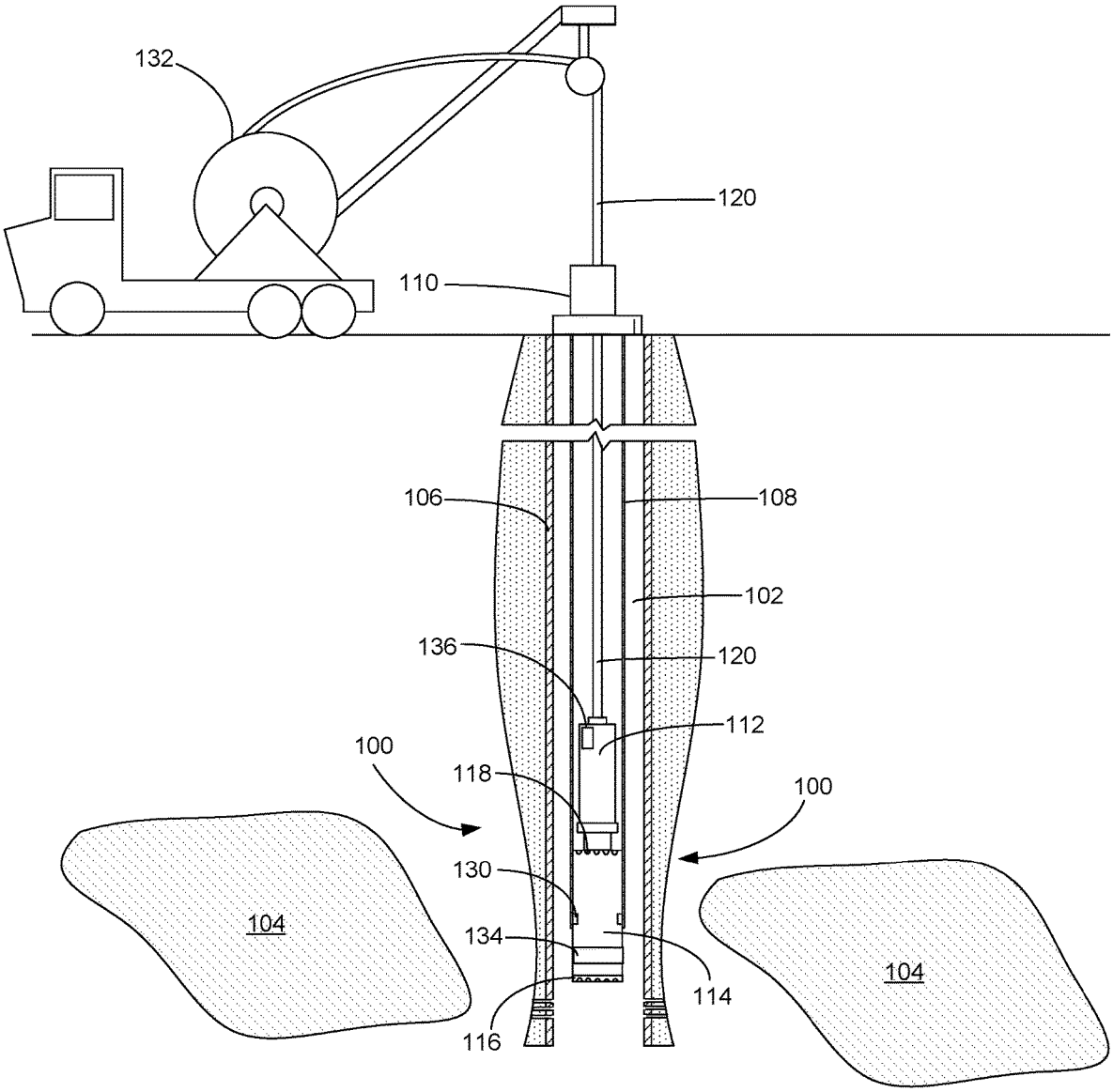
FIG. 1 is an elevational view of the deployment of an electric submersible pumping system with an integrated motor constructed in accordance with a first embodiment.

In accordance with exemplary embodiments of the present invention, FIG. 1 shows an elevational view of a first embodiment of an electric submersible pumping system 100 being deployed in a wellbore 102 within a subterranean formation 104. The wellbore 102 includes a casing 106, production tubing 108 and a wellhead 110.

The pumping system 100 includes an electric motor 112 and a pump 114, which are both sized and configured to be deployed through the interior of the production tubing 108. The motor 112 is a standard integrated motor in which the stator and rotor are contained within a common motor housing. The pump 114 is positioned below the motor 112 and provided with an intake 116 and discharge 118. As depicted in FIG. 1, the intake 116 is located on the bottom of the pump 114 and the discharge is located at the top of the pump 114 proximate the motor 112. It will be appreciated that the pumping system 100 may include additional components. For example, the pumping system 100 may include a seal section, gas separators, sensor modules and other components known in the art.

Figure 2:
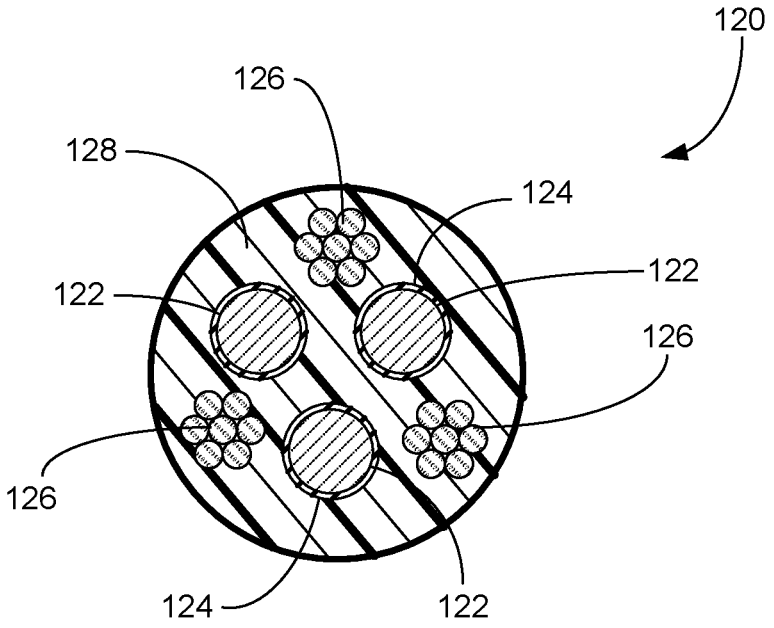
FIG. 2 is a cross-sectional view of an embodiment the reinforced power cable from the pumping system of FIG. 1.
Figure 3:
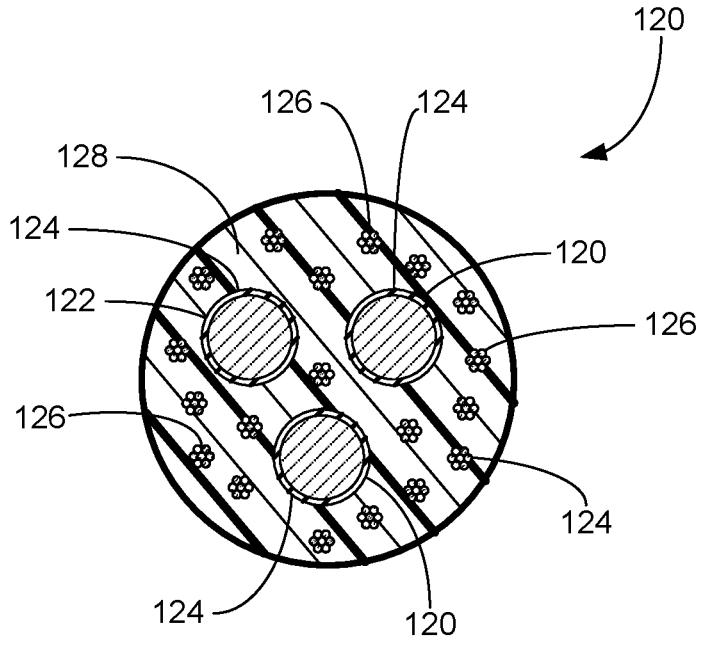
FIG. 3 is a cross-sectional view of another embodiment of the reinforced power cable from the pumping system of FIG. 1.

Electric power is supplied to the pumping system 100 through a reinforced power cable 120. In the embodiment depicted in FIG. 1, the reinforced power cable 120 is attached to the motor 112. As depicted in FIGS. 2 and 3, the reinforced power cable 120 includes a plurality of conductors 122 configured to deliver electrical power to the motor 112 within the pumping system 100. In exemplary embodiments, the reinforced power cable 120 includes three copper conductors 122, each configured to conduct a separate phase of electrical power. The conductors 122 include one or more insulator layers 124. The insulator layers 124 may be constructed from perfluoroalkyl (PFA) polymer, polypropylene or other polymers that exhibit favorable stability under elevated temperatures.

In the embodiment depicted in FIG. 2, the power cable 112 further includes three braided steel cables 126 that provide tensile strength to the power cable 112. In the embodiment depicted in FIG. 3, the power cable 112 includes a larger number of smaller braided steel cables 126. The braided steel cables 126 may be oriented such that the individual strands within some of the steel cables 126 are wound in opposite direction to the strands in other steel conductors to minimize torsional forces when the braided steel cables 126 are exposed to tension. In both embodiments, the power cable 112 utilizes an abrasion resistant external jacket 128. The jacket 128 is smooth and round to provide a sealing surface through the wellhead as the ESP is installed in the wellbore. The jacket 128 can be the constructed from lead or another corrosion-resistant material such as a stainless steel tube.

In other embodiments, the reinforced power cable 120 includes an external metal tubing surrounding the insulators 124. In these embodiments, the external metal tubing may provide sufficient tensile strength such that the reinforced power cable 120 may not require the internal steel cables 126.

Thus, the self-supporting power cable 112 generally includes both electrical conductors 122 and steel cables 126 that support the weight of the power cable 112 and pumping system 100 in the wellbore 102. This enables the pumping system 100 to be deployed within the production tubing 108 while supported by only the power cable 112.

In the first embodiment depicted in FIG. 1, the pumping system 100 includes a landing assembly 130 located in the production tubing 108. During installation, the motor 112 and pump 114 are connected to the reinforced power cable 120 and lowered from a surface-based spool 132 through the wellhead 110 and production tubing 108. The spool 132 may be mounted on mobile cranes (as depicted in FIG. 1). Similarly, the spool 132 can be mounted in a fixed position relative to the wellhead 110. Although the pumping system 100 is depicted in use with an inland wellbore 102, it will be appreciated that the pumping system 100 can also be used and deployed in offshore applications.

When the pump 114 reaches the landing assembly 130, the pump 114 is latched into a locked position inside the production tubing 108. In some embodiments, the landing assembly 130 includes retractable pins (not separately designated) that engage with a locking profile on the pump 114 to secure the pump 114 in a fixed position relative to the production tubing 108. The pumping system 100 can be retrieved by unlatching the pump 114 from the landing assembly 130 by overcoming the latching force of the landing assembly 130 and lifting the pumping system 100 out of the production tubing 108 with the reinforced power cable 120.

In the embodiment depicted in FIG. 1, the pumping system 100 does not include a separate seal section or motor protector. Instead, the pump 114 includes an integrated thrust bearing 134 to protect the motor 112 and pump 114 from axial forces generated during operation. To accommodate the expansion of motor lubricants during thermal cycling, the motor 112 can include an expansion compensator 136 to reduce the stress on seals from pressurized motor lubricants. The expansion compensator 136 can include one or more bags, pistons, labyrinth chambers or other mechanisms that permit thermal expansion and contraction of the lubricants within the motor 112. Although the expansion compensator 136 is depicted on top of the motor 112 in FIG. 3, the expansion compensator can be located elsewhere within the motor 112.

During operation, the motor 112 drives the bottom intake pump 114, which discharges pressurized wellbore fluids from the discharge 118 into the annular space between the motor 112 and the production tubing 108. The movement of the wellbore fluids around the outside of the motor 112 aids in convectively cooling the motor 112.

Figure 4:
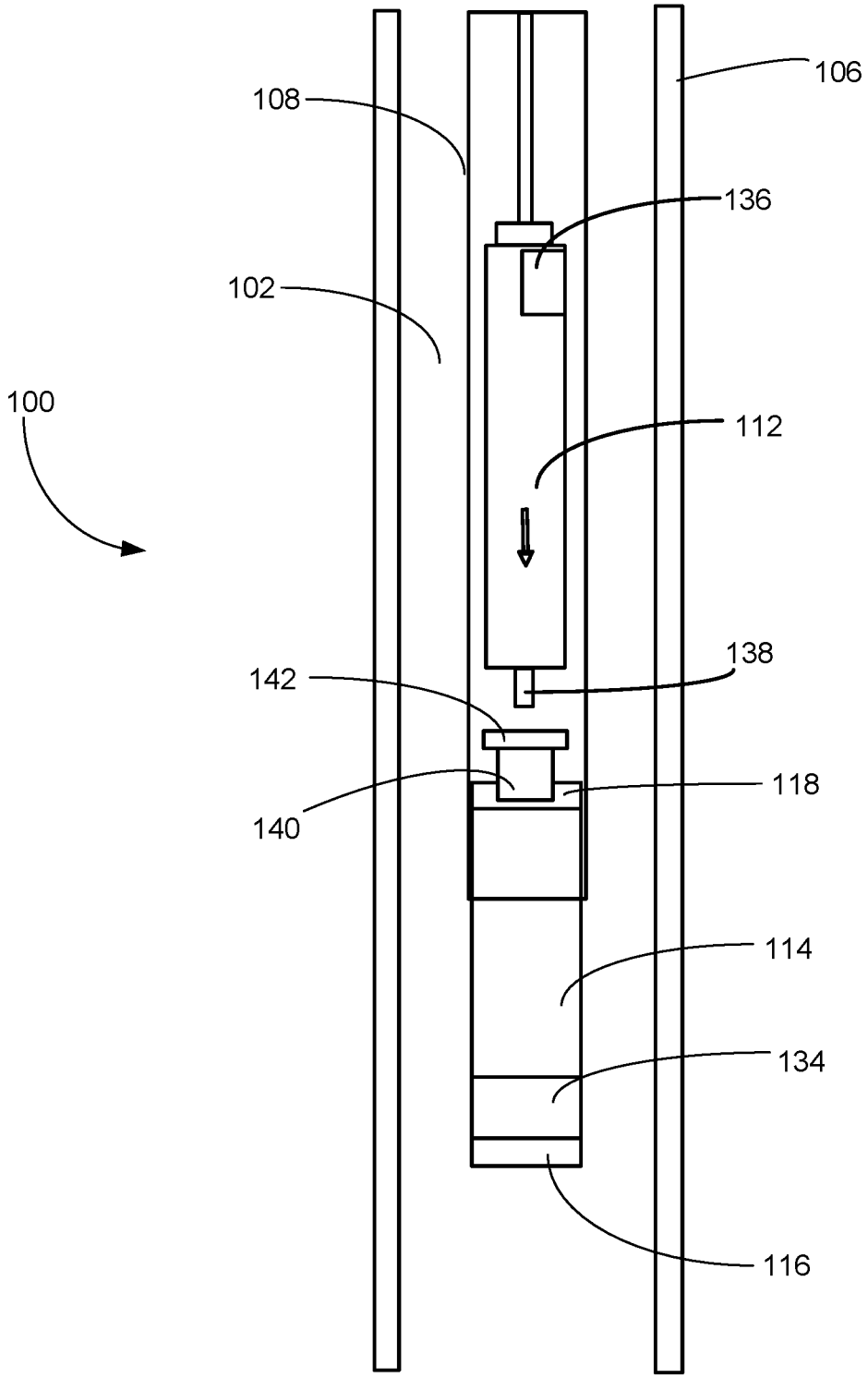
FIG. 4 depicts a second embodiment of the pumping system of FIG. 1.

Turning to FIG. 4, shown therein is a second embodiment of the pumping system 100 depicted in FIG. 1. In the embodiment depicted in FIG. 4, the pump 114 has been separately deployed into the production tubing 108 by a tether, such as a slickline or wireline and secured within the production tubing 108. Once the pump 114 is latched into the landing assembly 130, the tether can be retrieved. The motor 112 can then be connected to the reinforced power cable 120 and lowered into the production tubing 108 supported only by the reinforced power cable 120. Separately deploying the pump 114 and the motor 112 reduces the amount of weight carried by the reinforced power cable 120, which permits the use of larger pumps 114 and motors 112 for a given reinforced power cable 120. Alternatively, the reinforced power cable 120 can be made smaller to match the lesser weight of the isolated motor 112.

As depicted in FIG. 4, the motor 112 includes a shaft stinger 138 that extends beyond a sealed connection at the lower end of the motor 112 so that it can be captured by a mating shaft receiver 140 within the pump 114. The shaft stinger 138 can be tapered to facilitate landing within the shaft receiver 140. The shaft stinger 138 and shaft receiver 140 can be configured so that the motor 112 becomes laterally and rotationally aligned as the motor 112 is lowered into engagement with the pump 114. The motor 112 and pump 114 can be provided with a locking module 142 that locks the motor 112 into connection with the pump 114 when the shaft stinger 138 is captured by the shaft receiver 140 in the pump 114. Unless otherwise noted, the components in the embodiment depicted in FIG. 4 are the same as the embodiments depicted in FIG. 1.

Figure 5:
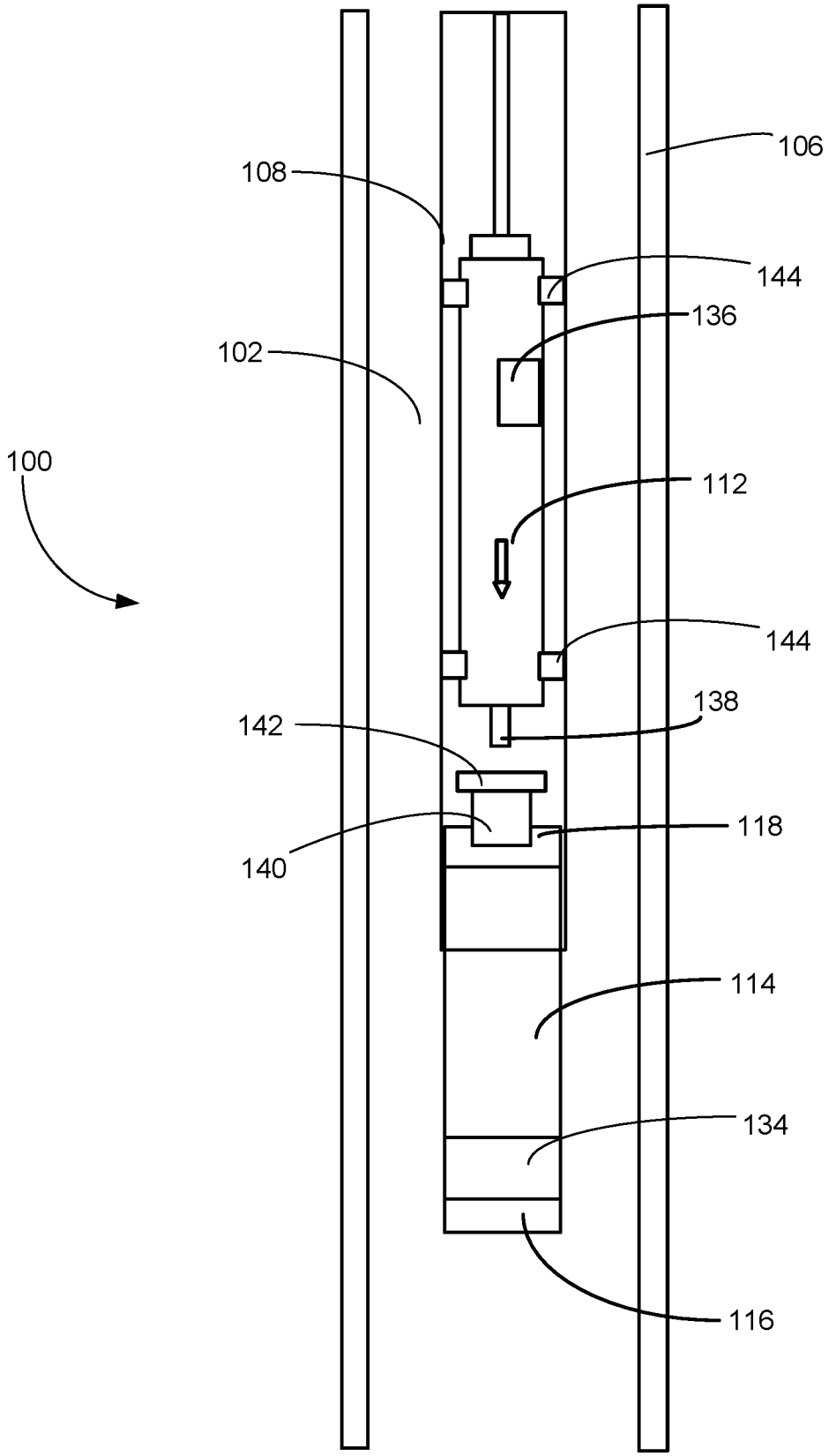
FIG. 5 depicts a third embodiment of the pumping system of FIG. 1.

Turning to FIG. 5, shown therein is a third embodiment of the pumping system 100 depicted in FIG. 1. In this third embodiment, the pump 114 can be deployed separately from the motor 112 using a tether as described above. The motor 112 is provided with one or more piston rings 144 extending radially outward from the motor 112 to the inner surface of the production tubing 108. The piston rings 144 are designed to completely or partially block the passage of fluid around the motor 112 so that the motor 112 can be deployed into the production tubing 108 with fluid pressure acting above or below the motor 112. In some embodiments, the size of fluid passages in the piston rings 144 can be adjusted by rotating the motor 112 with respect to the piston rings 114 or production tubing 108. The motor 112 can likewise be retrieved from the production tubing 108 by increasing the fluid pressure below the motor 112 to push the motor 112 upward out of the well 102. Using pressurized fluid to deploy and retrieve the motor 112 alleviates the load requirements of the reinforced power cable 120. In certain applications, the reinforced power cable 120 may include smaller steel cables 126 or no steel cables 126. In some applications, the pump 114 is also fitted with one or more piston rings 144 and pushed into position within the production tubing 108 under hydraulic pressure. Unless otherwise noted, the components in the embodiment depicted in FIG. 5 are the same as the embodiments depicted in FIG. 1.

Figure 6:
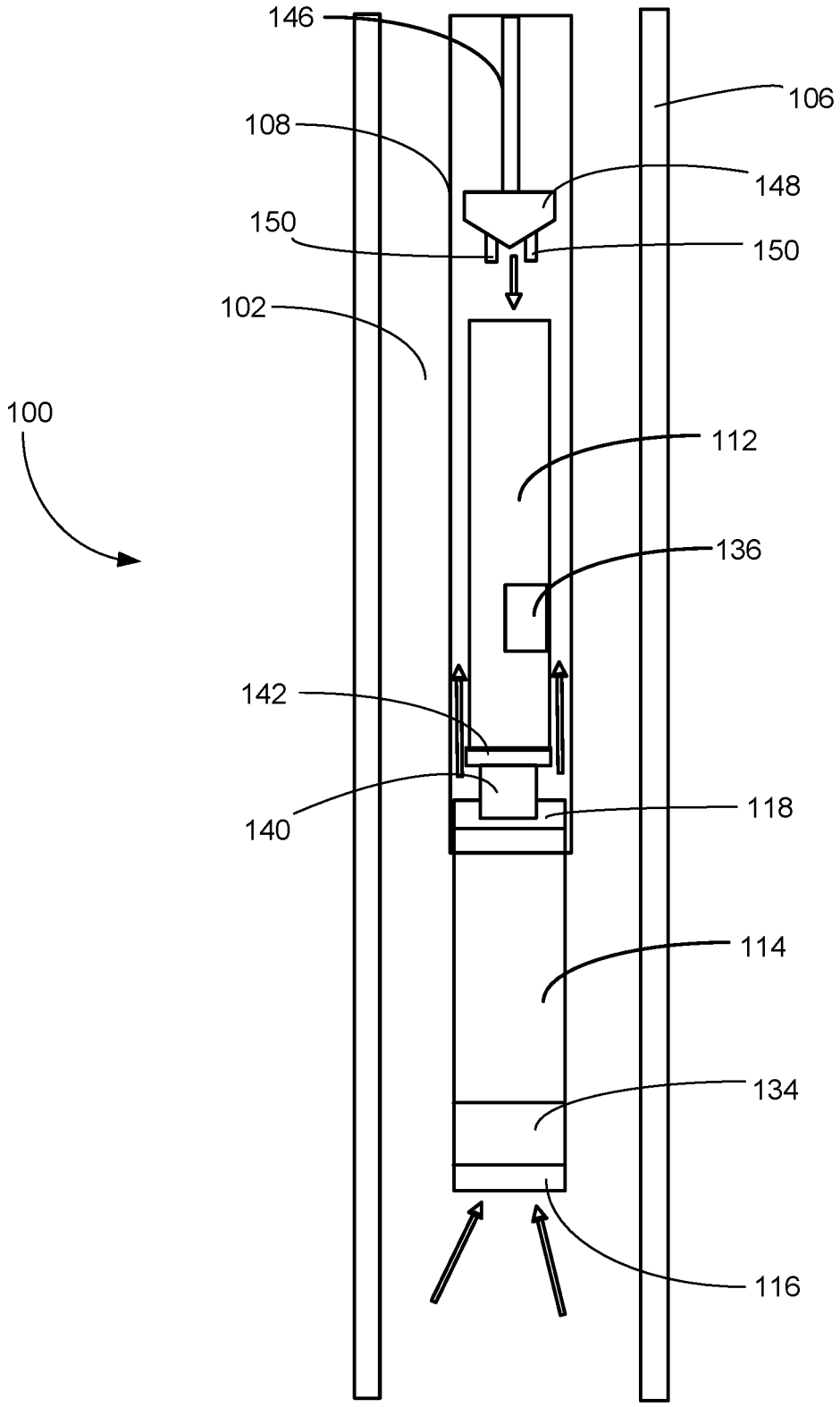
FIG. 6 depicts a fourth embodiment of the pumping system of FIG. 1.

Turning to FIG. 6, shown therein is a fourth embodiment of the pumping system 100. In this fourth embodiment, the pump 114 and motor 112 are deployed into the production tubing 108 with a tether. In this embodiment, the motor 112 is not attached to the reinforced power cable 120 during installation. Once the pump 114 and motor 112 have been secured to the production tubing 108 by the landing assembly 130 (as depicted in FIG. 6), a standard power cable 146 can be lowered through the production tubing 108 and connected to the motor 112. In this embodiment, the standard power cable 146 includes a motor lead extension, but the standard power cable 146 is not configured to support the weight of the motor 112 or pump 114. The standard power cable 146 can therefore be manufactured without the reinforcing steel cables 126. The standard power cable 146 can be provided with a specialized plug 148 that facilitates the in-situ connection between the standard power cable 146 and the motor 112.

The plug 148 and standard power cable 146 are optimally hermetically sealed to prevent the ingress of wellbore fluids into the plug 148 or standard power cable 146 during installation. In some applications, it may be desirable to fit the plug 148 or standard power cable 146 with piston rings 144 to permit the standard power cable 146 to be pumped into position on the motor 112 with fluid pressure. The plug 148 can be fitted with a plurality of pins 150, leads or concentric tubes that mate with corresponding leads or terminals on the top of the motor 112. A latching module can be used to secure the plug 148 into a secure engagement with the motor 112. Unless otherwise noted, the components in the embodiment depicted in FIG. 6 are the same as the embodiments depicted in FIG. 1.

Figure 7:
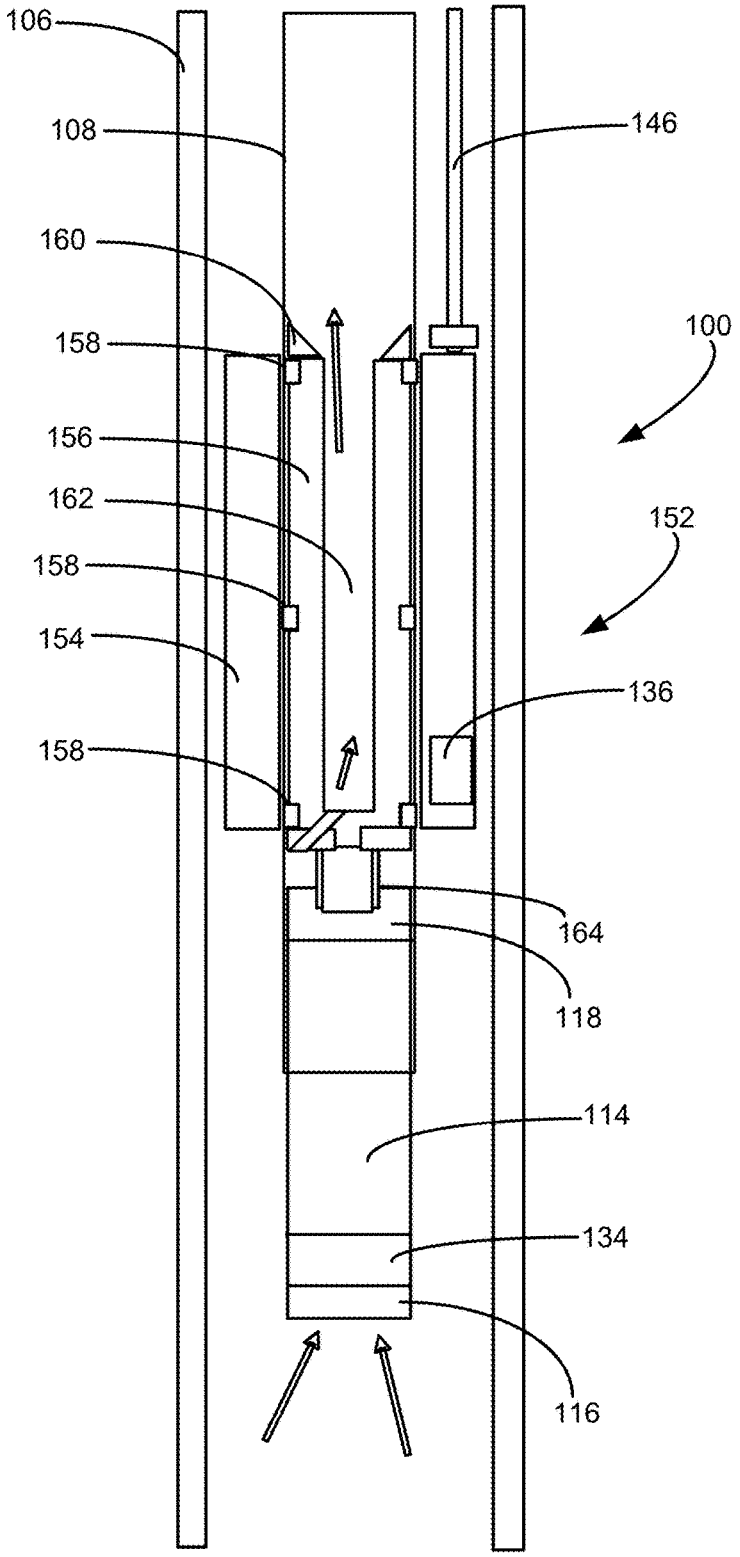
FIG. 7 depicts an embodiment of an electric submersible pumping system that includes a separated motor.

Turning to FIG. 7, shown therein is an embodiment of the pumping system 100 in which the pump 114 is driven by a separated motor 152 that includes an external stator 154 connected to the outside of the production tubing 108 and an open rotor 156 secured to the pump 114 inside the production tubing 108. The stator 154 is connected to the standard power cable 146, which delivers three-phase electrical power to the stator 154. The external stator 154 can include a dedicated expansion compensator 136 located inside or external to the stator 154. The expansion compensator 136 accommodates the expansion and contraction of motor lubricants during thermal cycling.

The open rotor 156 rides on bearings 158 between the outer diameter of the open rotor 156 and the inner diameter of the production tubing 108. Rotor seals 160 positioned on the top of the open rotor 156 contact the inner diameter of the production tubing 108 to prevent sand and other particles from falling between the open rotor 156 and the production tubing 108, where the bearings 158 could be contaminated.

In response to rotating magnetic fields produced by the phased windings inside the stator 154, the open rotor 156 rotates within the stationary production tubing 108 to drive the pump 114 through one or more interconnected shafts. The open rotor 156 includes a central passage 162 that provides a path for fluid discharged from the pump 114. The movement of fluid through the central passage 162 cools the open rotor 156 and stator 154. The pump 114 and open rotor 156 can be removed as a single unit by connecting a wireline to the open rotor 156 or pump 114.

Figure 8:
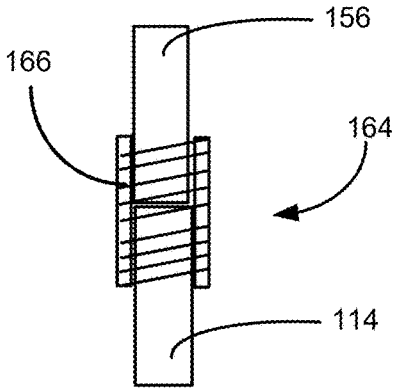
FIG. 8 depicts an embodiment of the one-way coupling of the pumping system of FIG. 7.

A one-way coupling 164 can be placed between the interconnected shafts of the open rotor 156 and the pump 114 to prevent the pump 114 from rotating in the reverse direction in the event fluid falls back through the production tubing 108. An example of the one-way coupling 164 is depicted in FIG. 8. In this embodiment, the one-way coupling 164 includes a spring-based clutch 166 that only couples the shafts from the pump 114 and open rotor 156 when the pump shaft is rotated in a specific direction (e.g., clockwise). In the opposite direction (e.g., counterclockwise), the spring releases the shaft from the open rotor 156 and the shaft from the pump 114 to prevent the unintended rotation of the open rotor 156 in an opposite direction. This prevents the unwanted generation of back-EMF current from fluid falling back through the pump 114, which presents a potential hazard to equipment and operators.

Figure 9:
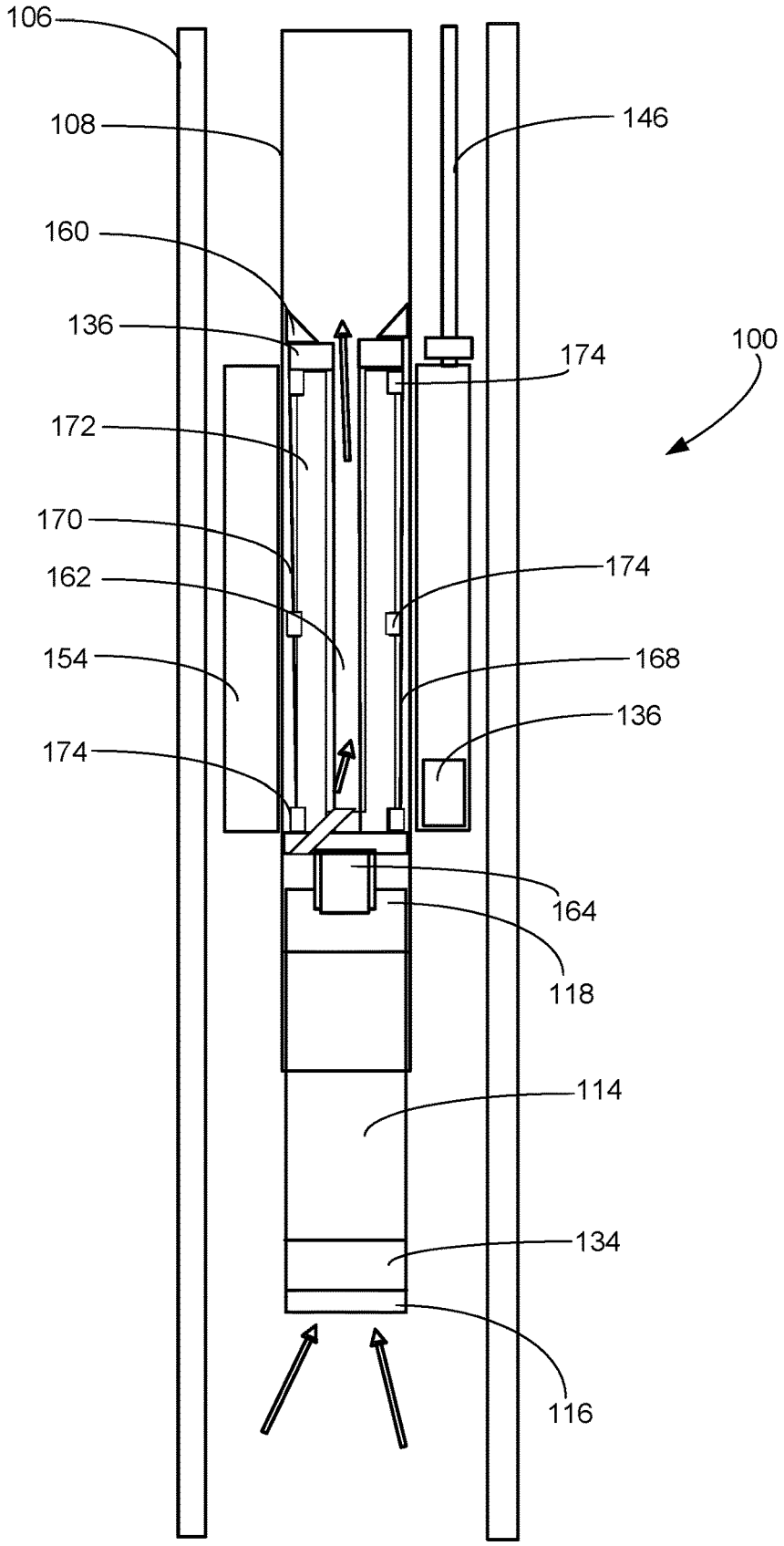
FIG. 9 depicts a second embodiment of the pumping system of FIG. 7.

Turning to FIG. 9, shown therein is an additional embodiment of the pumping system 100 depicted in FIG. 7. In this embodiment, the external stator 154 of the separated motor 152 drives an enclosed rotor 168 rather than the open rotor 156 depicted in FIG. 7. The enclosed rotor 168 includes a rotor housing 170 that fits closely within the inner diameter of the production tubing 108. The housing 170 has tabs or other features such that prevent the housing 170 from rotating when installed in the production tubing 108. The enclosed rotor 168 includes an internal rotor 172 that is configured to rotate within the rotor housing 170. Internal bearings 174 can be used to facilitate the rotation of the internal rotor 172 within the rotor housing 170. Because the rotor housing 170 does not rotate, the effectiveness of the rotor seals 160 is improved. Fluid produced by the pump 114 is carried through the central passage 162, which extends through the enclosed rotor 168. The housing 170 with the enclosed rotor 168 and internal bearings 174 is filled with lubricating oil. The expansion compensator 136 is located at the top or bottom of the rotor housing 170 to accommodate thermal expansion of this oil during operation. Unless otherwise noted, the components in the embodiment depicted in FIG. 9 are the same as the embodiments depicted in FIG. 8. A second expansion chamber 136 can be included within the external stator 154 to accommodate the expansion and contraction of fluids within the stator 154.

Figure 10:
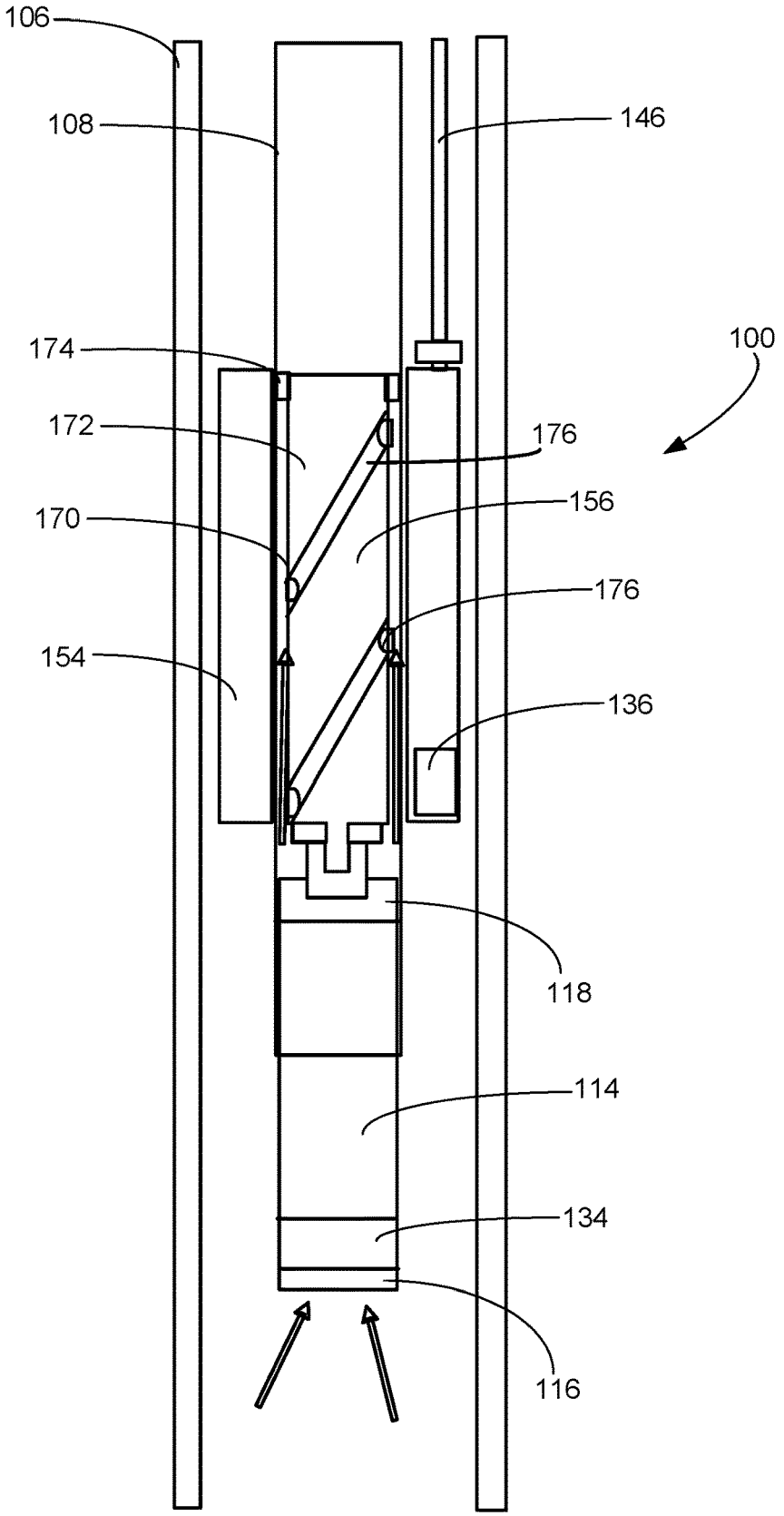
FIG. 10 depicts a third embodiment of the pumping system of FIG. 7.

Turning to FIG. 10, shown therein is another embodiment of the pumping system 100 depicted in FIG. 7. In this embodiment, the central passage 162 of the open rotor 156 is closed and fluid from the pump 114 is carried around the outside of the open rotor 156. As depicted in FIG. 10, the open rotor 156 can include external spiraled channels 176 that provide an auxiliary pumping action as the open rotor 156 rotates in response to magnetic fields produced by the external stator 154. Motor rotors typically rotate and operate like a squirrel cage induction motor and have internal conductor bars. The open rotor 156 depicted in FIG. 10 can be configured as a permanent magnet rotor because it has higher flux density and handles a higher airgap than are advisable for typical induction motors. Unless otherwise noted, the components in the embodiment depicted in FIG. 10 are the same as the embodiments depicted in FIG. 8.

Figure 11:
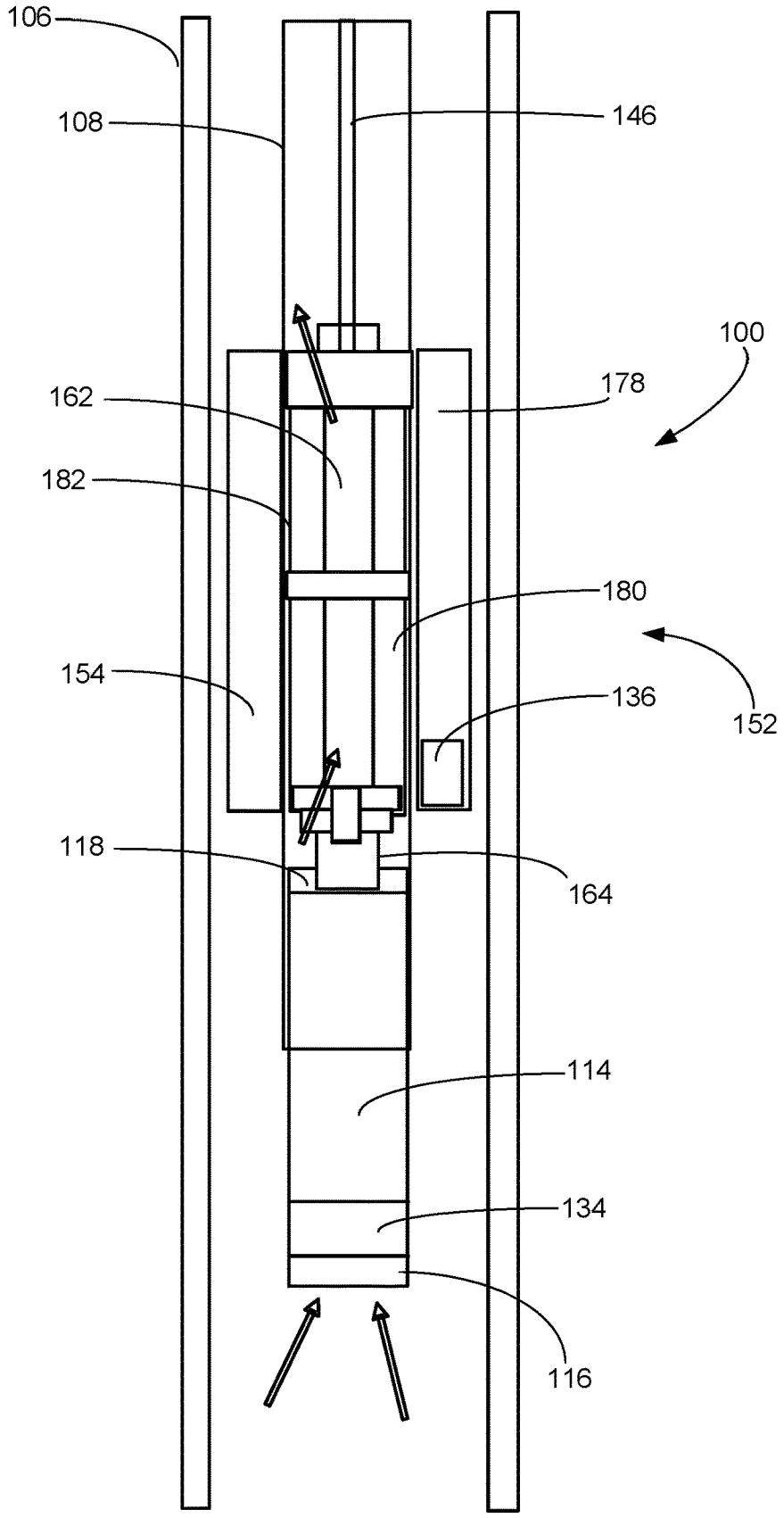
FIG. 11 depicts a fourth embodiment of the pumping system of FIG. 7.

Turning to FIG. 11, shown therein is another embodiment of the pumping system 100. In this embodiment, the separated motor 152 includes a permanent magnet external stator 178 and a powered internal rotor 180. The permanent magnet external stator 178 is located on the outside of the production tubing 108. The powered internal rotor 180 is contained within a rotor housing 182 inside the production tubing 108 within the internal space defined by the permanent magnet external stator 178. The powered internal rotor 180 has windings (not separately shown) and is optimally configured as a "brushless" system in which the commutation states of the powered internal rotor 180 are controlled through non-contact mechanisms.

During use, the standard power cable 146 supplies the powered internal rotor 180 with phased electric power, which is converted into magnetic fields within the windings of the powered internal rotor 180. This forces the powered internal rotor 180 to spin, thereby delivering torque to drive the pump 114. Fluid discharged from the pump 114 is carried through the central passage 162 of the powered internal rotor 180, which aids in cooling the separated motor 152.

In each of the embodiments outlined above, it may be desirable to incorporate a deep set subsurface safety valve. The subsurface safety valve is designed to be fail-safe, so that the wellbore is isolated in the event of any system failure or damage to the surface production-control facilities. A flow control valve can be positioned below the subsurface safety valve to selectively adjust the flow into the production tubing 108 from the wellbore 102.

Thus, the various embodiments of the pumping system 100 disclosed herein are well-suited for deployment and retrieval through the production tubing 108 in a live well intervention. In each case, the pumping system 100 includes a pump 114 driven by a motor, which may be an integrated motor 112 or a separated motor 152. The pumping system 100 can be provided power through a reinforced power cable 120 that is capable of supporting the weight of some combination of the motor 112 and pump 114, or through a standard power cable 146 that is not designed to carry the weight of additional downhole components. The integrated motor 112 and separated motor 152 can each be provided with internal compensators 136 that are configured to accommodate the expansion of internal liquid lubricants. The pump 114 can be provided with an internal thrust bearing 134 to offset the axial loads generated by the pumping system 100 during use.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts and steps within the principles of the present invention to the full extent indicated by the broad general meaning of the terms in which the appended claims are expressed. It will be further appreciated that unless otherwise excluded, aspects of one embodiment can be combined or incorporated into other embodiments disclosed herein. It will be appreciated by those skilled in the art that the teachings of the present invention can be applied to other systems without departing from the scope and spirit of the present invention.

What is claimed is:

1. A method of deploying a submersible pumping
installing production tubing in the well;
providing an external stator that includes an expansion compensator;
securing the external stator and the expansion compensator to the outside of the production tubing;
connecting a pump to a lower end of a rotor, wherein the rotor has a central passage that provides a path for fluid discharged from the pump and a rotor seal for preventing sand from becoming trapped between the rotor and the production tubing;
lowering the rotor and pump through the inside of the production tubing to a location at which the rotor is positioned inside the production tubing in proximity to the external stator, with the rotor seal in contact with an inner surface of the production tubing;
driving the pump with the rotor to discharge fluids out of the well through the production tubing; and
directing solids falling through the production tubing above the rotor through the central passage with the rotor seal.

2. The method of claim 1, wherein the step of securing the external stator to the outside of the production tubing occurs before the production tubing is installed in the well.

3. The method of claim 1, further comprising the step of connecting a tether to the pump before the step of lowering the rotor and pump through the inside of the production tubing.

4. The method of claim 1, further comprising the steps of:
connecting a power cable to the external stator; and
providing electric current to the external stator through the power cable to activate the rotor to drive the pump to produce fluids through the production tubing.

5. A downhole pumping system for use in producing fluids to the surface through production tubing, the downhole pumping system comprising:
a stator mounted to the outside of the production tubing, wherein the stator includes an expansion compensator;
a rotor mounted to the inside of the production tubing in proximity to the stator and configured for rotation inside the production tubing, wherein the rotor comprises a rotor seal on top of the rotor, wherein the rotor seal has a conical inner surface and contacts an inside surface of the production tubing; and
a pump driven by the rotor.

6. The downhole pumping system of claim 5, wherein the stator comprises one or more permanent magnets and wherein the rotor is a powered rotor that receives electrical power through a brushless connection.

7. The downhole pumping system of claim 5, wherein the stator is connected to a source of electrical power and configured to apply rotating magnetic fields to the rotor.

8. The downhole pumping system of claim 5, wherein the open rotor includes:

a central passage through which fluids are produced; and wherein the rotor seal is configured to prevent solids from becoming trapped between the rotor and the production tubing.

9. The downhole pumping system of claim 5, wherein the open rotor includes one or more spiraled channels around the outside of the open rotor that provide an auxiliary pumping action.

10. The downhole pumping system of claim 5, wherein the stator is integral with the production tubing.

11. The downhole pumping system of claim 5, wherein the rotor includes a plurality of bearings that allow the rotor to rotate inside the production tubing.

12. The downhole pumping system of claim 5, wherein the pump is connected below the rotor.

13. A downhole pumping system for use in producing fluids to the surface through production tubing, the downhole pumping system comprising:

a stator mounted to an outside of the production tubing, wherein the stator includes an expansion compensator configured to accommodate the expansion and contraction of lubricants in the motor;

a rotor mounted to an inside of the production tubing in proximity to the stator and configured for rotation inside the production tubing, wherein the open rotor comprises a rotor seal positioned on an upper surface of the open rotor in contact with the inside of the production tubing, wherein the rotor seal has a conical inner surface; and a shaft connected to the rotor; and a pump driven by the rotor through the shaft.

14. The downhole pumping system of claim 13 further comprising a one-way coupling between the rotor and the pump, wherein the one-way coupling is configured to prevent the pump from rotating in an unintended direction.

* * * * *